US009849719B1

(12) United States Patent
Mallahan, III

(10) Patent No.: US 9,849,719 B1
(45) Date of Patent: Dec. 26, 2017

(54) CONTAINER LIQUID CATCH RINGS

(71) Applicant: Lee G. Mallahan, III, Bossier City, LA (US)

(72) Inventor: Lee G. Mallahan, III, Bossier City, LA (US)

( * ) Notice: Subject to any disclaimer, the term of this patent is extended or adjusted under 35 U.S.C. 154(b) by 0 days.

(21) Appl. No.: 15/588,959

(22) Filed: May 8, 2017

(51) Int. Cl.
*B65D 23/06* (2006.01)
*B44D 3/12* (2006.01)
*B65D 25/20* (2006.01)

(52) U.S. Cl.
CPC ..... *B44D 3/128* (2013.01)

(58) Field of Classification Search
CPC ..... B65D 23/06; B65D 23/065; B44D 3/128
USPC ..... 220/299, 729, 733; 215/392
See application file for complete search history.

(56) References Cited

U.S. PATENT DOCUMENTS 134,302 A * 12/1872 Miller ..... B65D 23/065 15/248.1
445,569 A * 2/1891 Morningstar ..... B65D 23/065 15/245
2,416,600 A * 2/1947 Waddell ..... B44D 3/128 220/696
2,630,241 A 3/1953 Schnabel
2,948,452 A * 8/1960 Grogan ..... A23G 9/503 215/392
3,693,829 A 9/1972 Price
4,020,968 A 5/1977 Chiavola et al.
4,369,890 A 1/1983 Bennett
4,437,583 A * 3/1984 O'Connor ..... B65D 23/065 116/206
D285,778 S 9/1986 Smith
5,335,806 A * 8/1994 Dedoes ..... B44D 3/127 220/287
6,609,629 B2 8/2003 Lucey
2003/0189068 A1* 10/2003 Nash ..... B65D 23/065 222/571
2006/0096989 A1* 5/2006 Lucey ..... B44D 3/12 220/495.11
2010/0116779 A1* 5/2010 Erez ..... A47G 19/22 215/393
2016/0001589 A1* 1/2016 Zimdahl ..... B44D 3/128 220/698

* cited by examiner

*Primary Examiner* — J. Gregory Pickett
*Assistant Examiner* — Niki M Eloshway
(74) *Attorney, Agent, or Firm* — R. Keith Harrison

(57) ABSTRACT

Container liquid catch rings which can be placed on a liquid container to catch and collect residual liquid from the container may include a ring body configured for placement on the liquid container in surrounding and substantially liquid-sealing relationship thereto. A ring opening may be formed by the ring body. The ring opening may be substantially sized and configured to accommodate the liquid container. A catch channel may be provided in the ring body in exterior concentric relationship to the ring opening. Liquid container and container liquid catch ring combinations are also disclosed.

13 Claims, 11 Drawing Sheets

CONTAINER LIQUID CATCH RINGS

FIELD

Illustrative embodiments of the disclosure generally relate to liquid-containing containers such as paint cans and the like. More particularly, illustrative embodiments of the disclosure relate to container liquid catch rings which can be placed on a liquid container to catch and collect residual liquid from the container.

SUMMARY

Illustrative embodiments of the disclosure are generally directed to container liquid catch rings which can be placed on a liquid container to catch and collect residual liquid from the container. An illustrative embodiment of the container liquid catch rings may include a ring body configured for placement on the liquid container in surrounding and substantially liquid-sealing relationship thereto. A ring opening may be formed by the ring body. The ring opening may be substantially sized and configured to accommodate the liquid container. A catch channel may be provided in the ring body in exterior concentric relationship to the ring opening.

Illustrative embodiments of the disclosure are further generally directed to liquid container and container liquid catch ring combinations. An illustrative embodiment of the liquid container and container liquid catch ring combinations may include a liquid container having a container bottom and a container wall extending from the container bottom. A container liquid catch ring may be provided on the liquid container. The container liquid catch ring may include a ring body on the liquid container in surrounding and substantially liquid-sealing relationship to the container wall. The ring body may be positional at a selected height on the liquid container. A catch channel may be provided in the ring body in exterior concentric relationship to the container wall of the liquid container.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
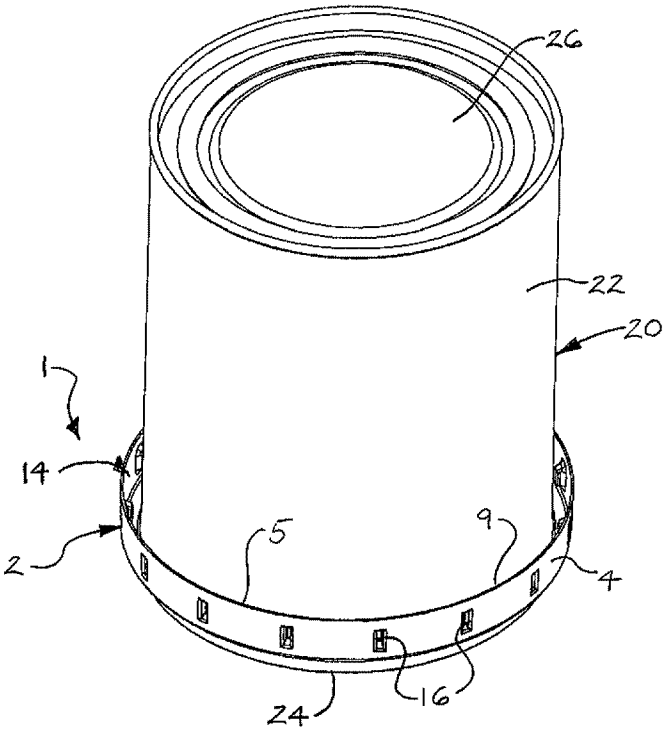
FIG. 1 is a perspective view of an illustrative embodiment of the container liquid catch rings, deployed in place on a liquid container in typical application of the container liquid catch ring.
Figure 2:
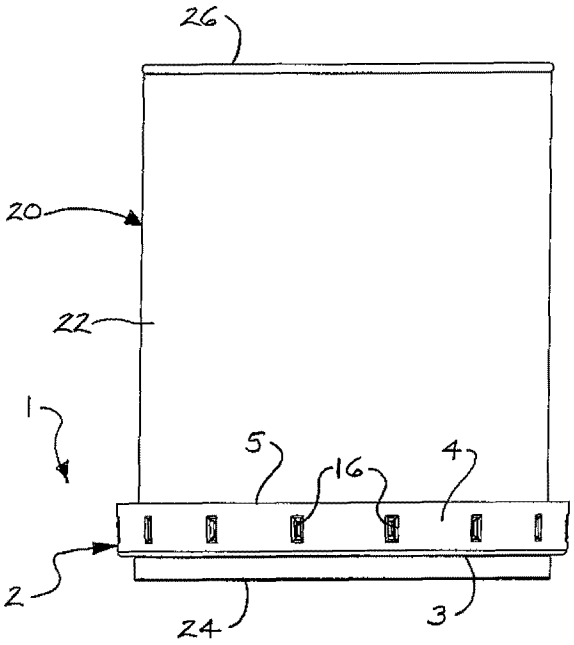
FIG. 2 is a front view of the illustrative container liquid catch ring and liquid container illustrated in FIG. 1.

Referring initially to FIGS. 1-9 of the drawings, an illustrative embodiment of the container liquid catch ring, hereinafter ring, is generally indicated by reference numeral 1. As illustrated in FIGS. 1 and 2 and will be hereinafter described, the ring 1 may be deployed in place at a selected height on a liquid container 20 which contains a supply of liquid (not illustrated). In some applications, for example and without limitation, the liquid container 20 may be a commercially-available paint can which contains a supply of liquid paint. The liquid container 20 may have a cylindrical container wall 22 which extends from a container bottom 24. A removable container lid 26 may be placed on the container wall 22 to close the interior of the liquid container 20. The container lid 26 may be removed from the container wall 22 to open and access the liquid in the liquid container 20, typically in the conventional manner. The ring 1 may be suitable for catching residual liquid in the event that the liquid spills over the upper end of the container wall 22 and runs down the container wall 22. Accordingly, the ring 1 may be effective to prevent the liquid from accumulating on a floor (not illustrated) or other supporting surface on which the liquid container 20 is placed during and/or after use. The ring 1 may be selectively height-adjustable on the liquid container 20.

As illustrated in FIGS. 3-7, the ring 1 may include a ring body 2. In some embodiments, the ring body 2 may be annular in shape to match a cylindrical container wall 22 of the liquid container 20. In other embodiments, the ring body 2 may have other shapes for liquid containers 20 of alternative shapes. The ring body 2 may be suitably configured for placement on the liquid container 20 in surrounding and substantially liquid-sealing relationship to the liquid container 20. In some embodiments, the ring body 2 may include a stretchable and elastic material having recoil memory, such as rubber, silicone and/or silicone-based materials, for example and without limitation. In other embodiments, the ring body 2 may include a substantially rigid or semi-rigid material such as rubber, plastic and/or composite materials, for example and without limitation.

Figure 7:
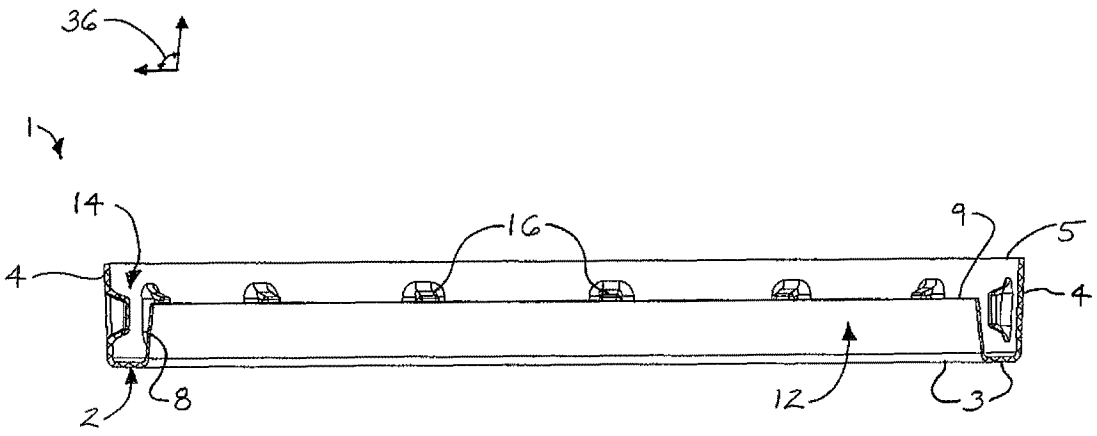
FIG. 7 is a transverse sectional view of the illustrative container liquid catch ring.

As illustrated in FIG. 7, in some embodiments, the ring body 2 may include a ring bottom 3. The ring bottom 3 may be flat or planar. A ring outer wall 4 may extend from the ring bottom 3. The ring outer wall 4 may have an outer wall edge 5. In some embodiments, the ring outer wall 4 may be generally perpendicular to the ring bottom 3 in cross-section. In some embodiments, a ring inner wall 8 may extend from the ring bottom 3 in spaced-apart relationship to the ring outer wall 4. The ring inner wall 8 may have an inner wall edge 9. A catch channel 14 may be formed by and between the ring bottom 3, the ring outer wall 4 and the ring inner wall 8.

Figure 6:
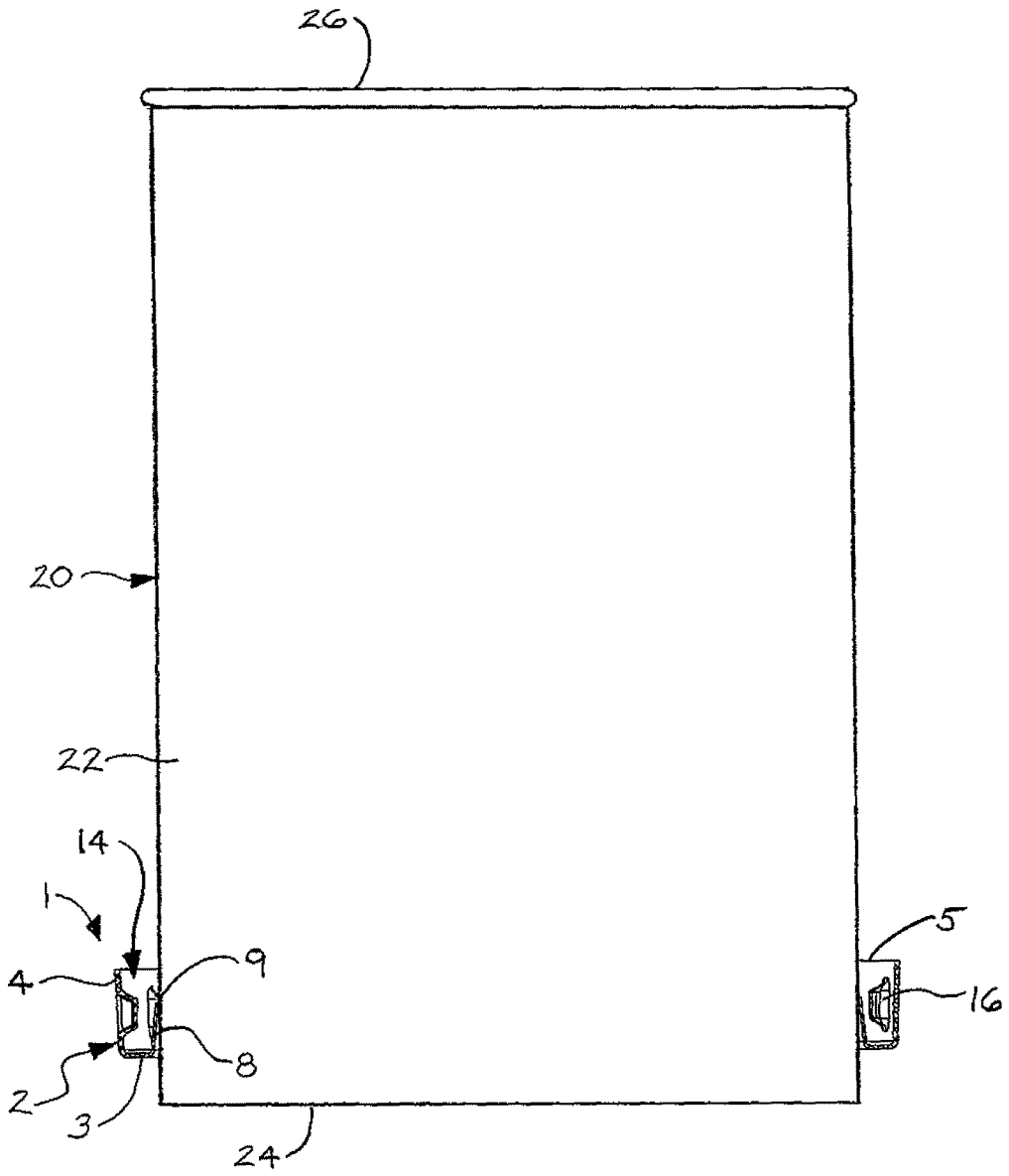
FIG. 6 is a transverse sectional view of the illustrative container liquid catch ring, deployed in place on a liquid container in typical application of the container liquid catch ring.

A ring opening 12 may be formed by the ring body 2. The ring opening 12 may be substantially sized and configured to accommodate the liquid container 20. The ring opening 12 may be disposed in interior concentric relationship to the catch channel 14. In some embodiments, the ring opening 12 may be formed by the ring inner wall 8 of the ring body 2. As further illustrated in FIG. 7, in some embodiments, the ring inner wall 8 may be disposed at an obtuse angle 36 with respect to the ring bottom 3 and may gradually angle into the ring opening 12 from the ring bottom 3 to the inner wall edge 9. Therefore, the diameter of the inner wall edge 9 on the ring inner wall 8 may be less than the diameter of the container wall 22 on the liquid container 20. Upon deployment of the ring 1 on the liquid container 20, the liquid container 20 may deform the ring inner wall 8 outwardly toward the ring outer wall 4 and into the catch channel 14. Thus, as illustrated in FIG. 6, the inner wall edge 9 of the ring inner wall 8 may recoil against and snugly engage the exterior surface of the container wall 22 of the liquid container 20 to form a substantially liquid-tight seal between the ring inner wall 8 and the container wall 22. This expedient may prevent seepage of the residual liquid between the exterior surface of the container wall 22 and the inner wall edge 9 of the ring inner wall 8.

As further illustrated in FIG. 6, in some embodiments, the inner wall edge 9 of the ring inner wall 8 may be recessed with respect to the outer wall edge 5 of the ring outer wall 4. Thus, in the event that the liquid fills the catch channel 14 to the level of the ring inner edge 9 on the ring inner wall 8, the portion of the container wall 22 above the ring inner edge 9 may serve as the inner wall of the ring body 2 until the level of the residual liquid reaches the outer wall edge 5 on the ring outer wall 4. In other embodiments, the inner wall edge 9 of the ring inner wall 8 may be at the same level as or at a higher level than the outer wall edge 5 of the ring outer wall 4.

Figure 3:
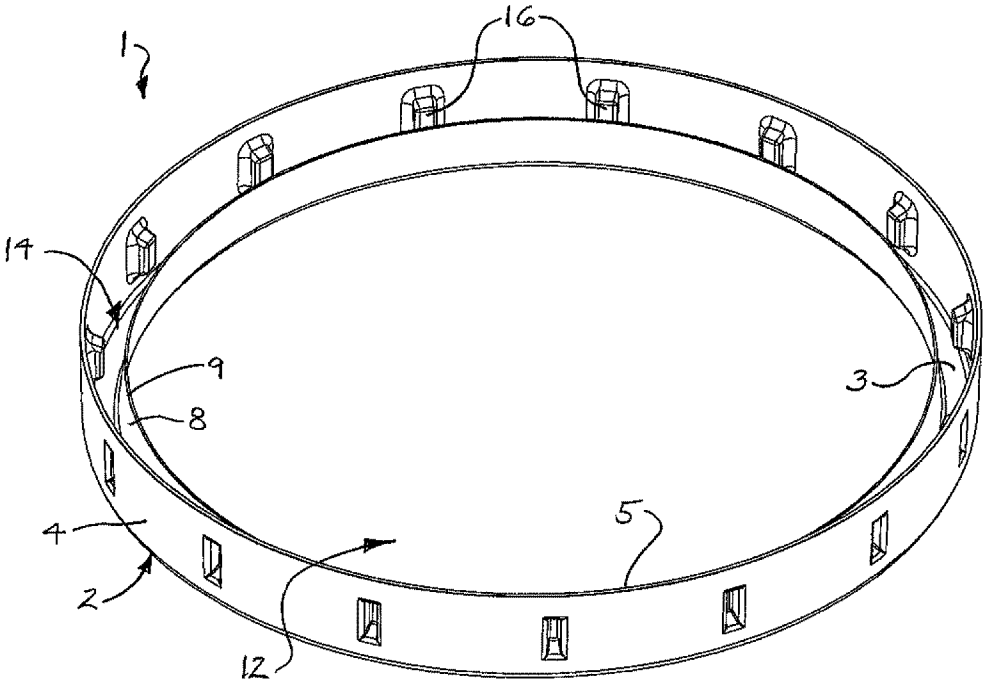
FIG. 3 is a perspective view of the illustrative container liquid catch ring.
Figure 4:
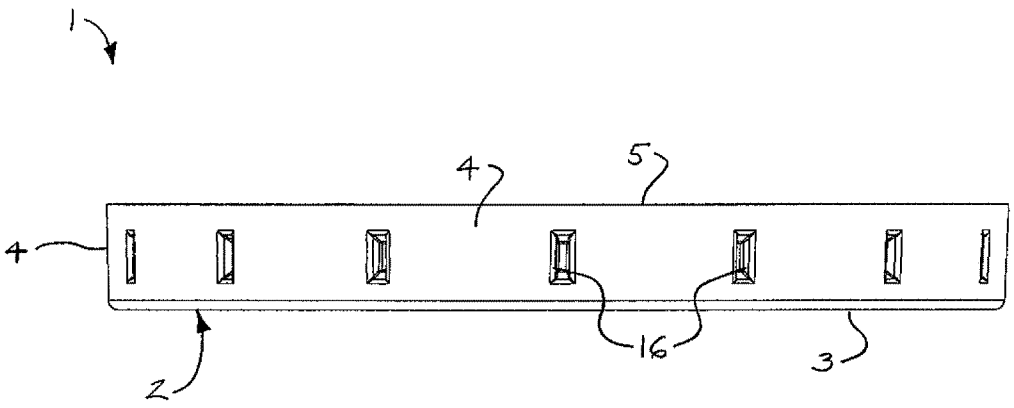
FIG. 4 is a front view of the illustrative container liquid catch ring.
Figure 5:
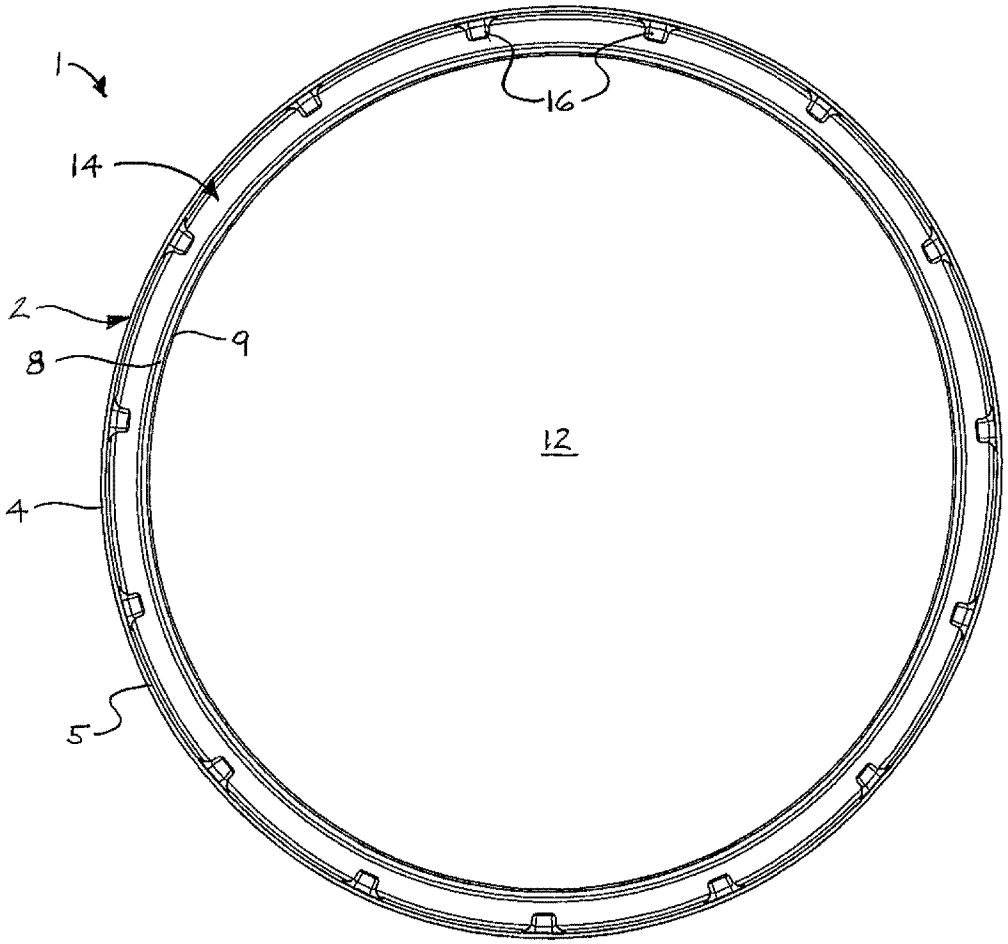
FIG. 5 is a top view of the illustrative container liquid catch ring.

As illustrated in FIGS. 3, 5 and 7, in some embodiments, multiple wall spacers 16 may protrude from at least one of the ring outer wall 4 and the ring inner wall 8 into the catch channel 14. The wall spacers 16 may be arranged in spaced-apart relationship to each other around the circumference or perimeter of the ring body 2. The wall spacers 16 may protrude from the ring outer wall 4, as illustrated. Alternatively, the wall spacers 16 may protrude from the ring inner wall 8. Still further in the alternative, the wall spacers 16 may protrude from the ring outer wall 4 and the ring inner wall 8 in alternating or other relationship to each other. In some embodiments, the wall spacers 16 may be formed as protrusions from the ring outer wall 4, the ring inner wall 8, or both. During use of the ring 1, in the event that the ring outer wall 4 is inadvertently bumped or otherwise deformed toward the ring inner wall 8 while the residual liquid is contained in the catch channel 14, the wall spacers 16 may bridge the catch channel 14 and engage the ring inner wall 8. The wall spacers 16 may thus limit narrowing of the catch channel 14 to prevent forcible expulsion of the liquid from the ring body 2.

Figure 8:
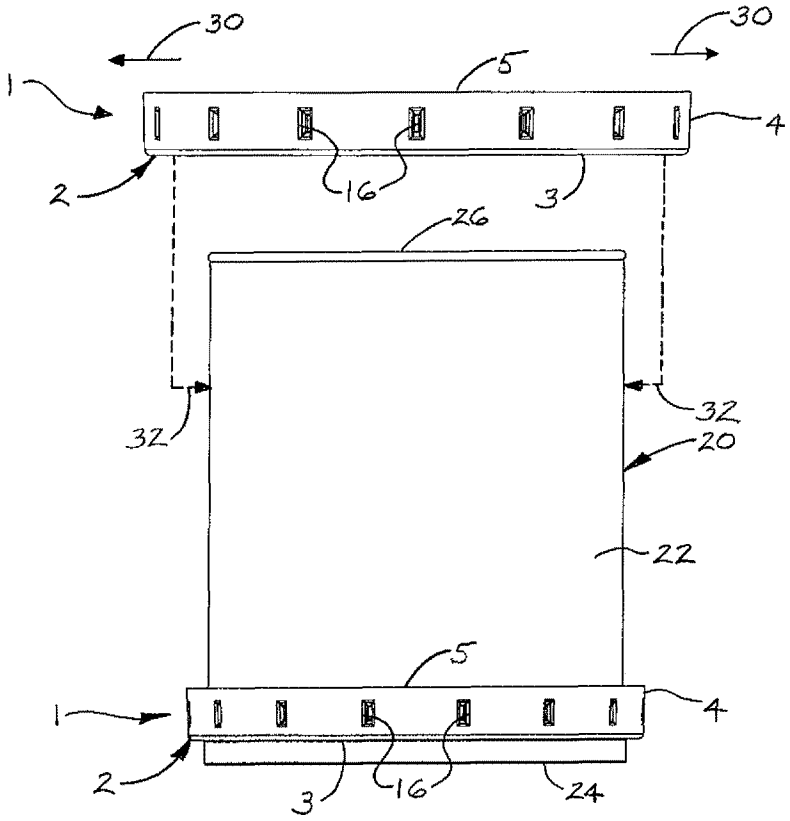
FIG. 8 is an exploded front view of the illustrative container liquid catch ring and liquid container, more particularly illustrating initial expansion or stretching of the container liquid catch ring preparatory to deployment of the container liquid catch ring on the liquid container, followed by placement of the container liquid catch ring around the liquid container and release and recoil of the container liquid catch ring in place against the liquid container according to some methods of deploying the container liquid catch ring on the liquid container.
Figure 9:
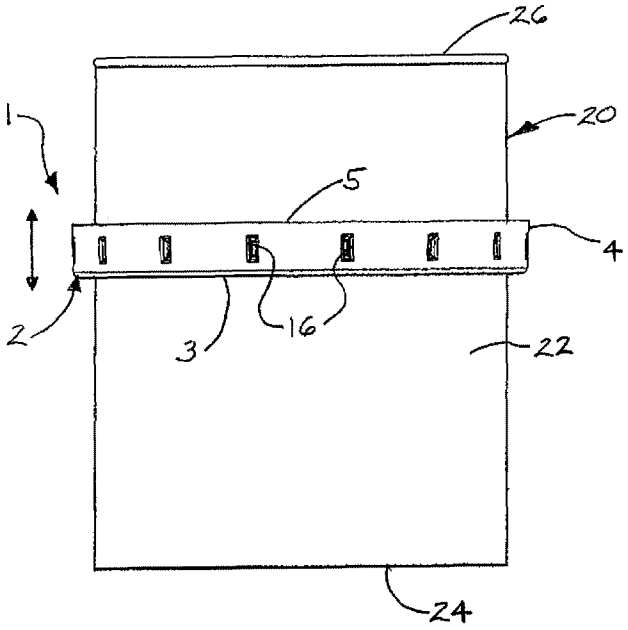
FIG. 9 is a front view of the illustrative container liquid catch ring, deployed in place on the liquid container, more particularly illustrating vertical positional adjustment of the container liquid catch ring on the liquid container.

As illustrated in FIGS. 1, 2, 6, 8 and 9, in typical application, the ring 1 may be deployed in place on a liquid container 20 which contains a supply of paint or other liquid (not illustrated) which is to be accessed and removed from the liquid container 20. Accordingly, as illustrated in FIGS. 8 and 9, in embodiments in which the ring body 2 is fabricated of a stretchable and elastic material having recoil memory, the ring body 2 may initially be held above the liquid container 20 and stretched outwardly, as indicated by the stretch arrows 30 in FIG. 8. The stretched ring body 2 may then be lowered in place over the liquid container 20 as the ring opening 12 in the ring body 2 receives the liquid container 20 until the ring body 2 is positioned at a selected height on the liquid container 20. Next, the ring body 2 may be released such that the ring body 2 recoils against the container wall 22 of the liquid container 20, as indicated by the recoil arrows 32 in FIG. 8. Thus, as illustrated in FIG. 6, the inner wall edge 9 of the ring inner wall 8 may recoil against and snugly engage the exterior surface of the container wall 22, forming a substantially liquid-tight seal with the container wall 22. In embodiments in which the ring body 2 is fabricated of a rigid or semi-rigid rubber, plastic, composite and/or other material, the ring body 2 may be snapped in place in a friction-fit against the container wall 22 at a selected height on the liquid container 20.

After the ring 1 is deployed in place, the liquid container 20 may be opened to access the liquid in the liquid container typically by removal of the container lid 26 from the container wall 22. During the course of removing the liquid from the liquid container 20, residual liquid may spill over the upper edge or rim of the container wall 22 and run down the exterior of the container wall 22. Accordingly, some of the residual liquid may run down into the catch channel 14 in the ring body 2 of the ring 1. Thus, the ring 1 may stop the flow of the residual liquid down the container wall 22 and prevent the residual liquid from running down the remaining portion of the container wall 22 onto the floor or other supporting surface (not illustrated) on which the liquid container 20 rests.

In some applications, the residual liquid may accumulate in the catch channel 14 until the residual liquid reaches the level of the inner wall edge 9 on the ring inner wall 8. Therefore, the portion of the container wall 22 of the liquid container 20 which extends above the ring inner edge 9 may serve as the inner wall of the ring body 2 until the level of the residual liquid reaches the outer wall edge 5 on the ring outer wall 4. It will be appreciated by those skilled in the art that the substantially liquid-tight seal between the inner wall edge 9 on the ring inner wall 8 and the exterior surface of the container wall 22 may prevent the residual liquid from seeping between the ring inner wall 8 down the remaining portion of the container wall 22 onto the floor or other supporting surface. In the event that the ring outer wall 4 is inadvertently bumped or otherwise deformed toward the ring inner wall 8 while the residual liquid is contained in the catch channel 14, the wall spacers 16 may bridge the catch channel 14 and engage the ring inner wall 8, thus limiting narrowing of the catch channel 14 and preventing forcible expulsion of the residual liquid from the ring body 2.

After use, the ring 1 may be removed from the liquid container 20, the residual liquid emptied from the catch channel 14 and the ring 1 washed preparatory to subsequent use. Alternatively, the ring 1 may remain in place on and ultimately be discarded with the liquid container 120.

Figure 10:
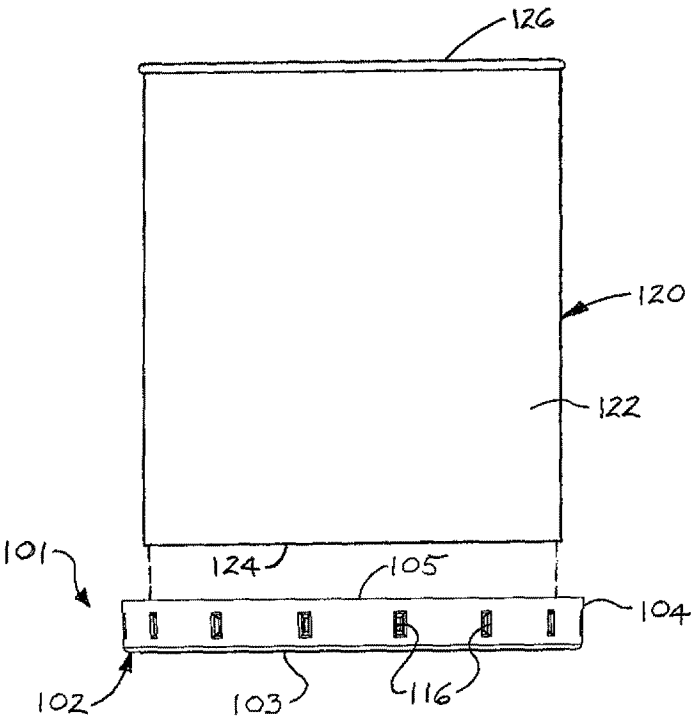
FIG. 10 is a front view of an alternative illustrative container liquid catch ring, more particularly illustrating deployment of the container liquid catch ring on the liquid container by lowering the liquid container in place through the container liquid catch ring.
Figure 11:
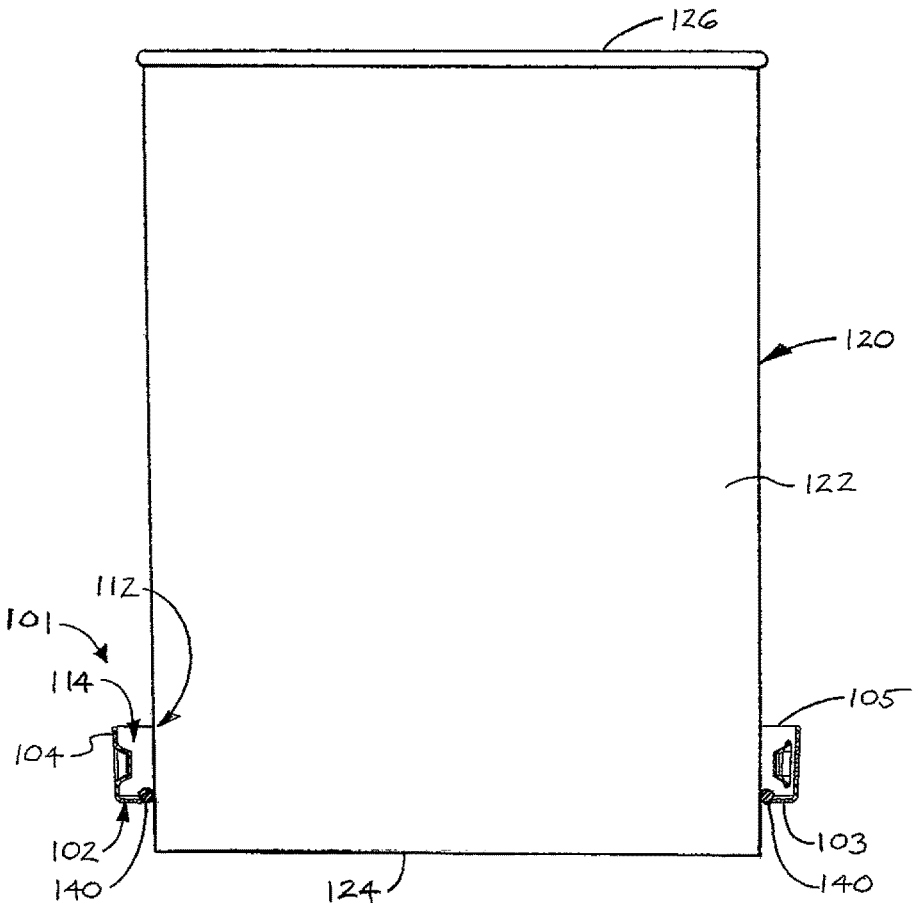
FIG. 11 is a transverse sectional view of the container liquid catch ring of FIG. 10, deployed in place on the liquid container.

Referring next to FIGS. 10 and 11 of the drawings, an alternative illustrative embodiment of the container liquid catch ring is generally indicated by reference numeral 101. In the ring 101, elements which are analogous to the respective elements of the ring 1 that was heretofore described with respect to FIGS. 1-9 are designated by the same respective numerals in the 101-140 series in FIGS. 10 and 11. As illustrated in FIG. 11, in the ring 101, the ring inner wall (reference numeral 8 in FIGS. 1-9) may be omitted from the ring body 102. A sealing bead 140 may terminate the interior edge of the ring bottom 103 of the ring body 102. Accordingly, the sealing bead 140 may form a substantially liquid-tight seal with the container wall 122 of the liquid container 120.

Application of the ring 101 may be as was heretofore described with respect to the ring 1 in FIGS. 1-9. As illustrated in FIG. 10, the ring 101 may be deployed in place on the liquid container 120 by initially placing the ring 101 on a floor or other supporting surface (not illustrated). The liquid container 120 may be lowered in place through the ring opening 112 of the ring body 102 until the container bottom 124 rests on the floor or other supporting surface. The ring 101 may then be raised to the selected height on the liquid container 20. The sealing bead 140 may snugly engage and form a substantially liquid-tight seal with container wall 122 of the liquid container 120, as illustrated in FIG. 11. Thus, the container wall 122 may perform the same function as the ring inner wall 8 of the ring 1 which was heretofore described in FIGS. 1-9. After use, the ring 101 may be removed from the liquid container 120, the residual liquid emptied from the catch channel 114 and the ring 101 washed preparatory to subsequent use. Alternatively, the ring 101 may remain in place on and ultimately be discarded with the liquid container 120.

It will be appreciated by those skilled in the art that the container liquid catch rings of the disclosure can be fabricated of any of various materials including but not limited to rigid or semi-rigid rubber, plastics and/or composite materials or stretchable and elastic material having recoil memory such as rubber, silicone and/or silicone-based materials, for example and without limitation. The container liquid catch rings may be fabricated using conventional molding and other techniques known by those skilled in the art. The container liquid catch rings can be fabricated in a variety of different sizes for placement on liquid containers of various sizes. Moreover, the container liquid catch rings can be fabricated in various shapes to accommodate different shapes of liquid containers. It will be further appreciated by those skilled in the art that the height of the container liquid catch ring on the liquid container can be selected depending on such factors as the viscosity of the liquid which is in the liquid container. For example, thinner or less viscous liquids may have a tendency to travel farther down the container wall than thicker or more viscous liquids, thereby necessitating a lower placement of the container liquid catch ring on the liquid container. Conversely, thicker or more viscous liquids may have a tendency to travel a shorter distance down the container wall, thereby necessitating a higher placement of the container liquid catch ring on the liquid container.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A container liquid catch ring for deployment on a liquid container, comprising:

a ring body configured for placement on the liquid container in surrounding and substantially liquid-sealing relationship thereto, the ring body having a ring bottom, a ring outer wall extending from the ring bottom and a ring inner wall extending from the ring bottom in spaced-apart relationship to the ring outer wall;

a ring opening formed by the ring body, the ring opening substantially sized and configured to accommodate the liquid container;

a catch channel in the ring body in exterior concentric relationship to the ring opening, the catch channel formed by and between the ring bottom, the ring outer wall and the ring inner wall; and a plurality of wall spacers protruding from at least one of the ring outer wall and the ring inner wall into the catch channel, the plurality of wall spacers each having a protrusion cavity at a first surface of the at least one of the ring outer wall and the ring inner wall and each protruding beyond a second surface of the at least one of the ring outer wall and the ring inner wall.

2. The container liquid catch ring of claim 1 wherein the ring body comprises a substantially rigid or semi-rigid material.

3. The container liquid catch ring of claim 1 wherein the ring body comprises a stretchable and elastic material having recoil memory.

4. The container liquid catch ring of claim 1 wherein the ring inner wall is recessed with respect to the ring outer wall.

5. The container liquid catch ring of claim 1 wherein the ring inner wall is disposed at an obtuse angle with respect to the ring bottom and protrudes into the ring opening.

6. The container liquid catch ring of claim 1 further comprising a sealing bead on the ring bottom, the sealing bead configured to engage the liquid container in liquid-sealing relationship thereto.

7. A container liquid catch ring for deployment on a liquid container, comprising:

a ring body configured for placement on the liquid container in surrounding and substantially liquid-sealing relationship thereto, the ring body including a ring bottom, a ring outer wall extending from the ring bottom and a ring inner wall extending from the ring bottom in spaced-apart relationship to the ring outer wall, the ring inner wall recessed with respect to the ring outer wall;

a ring opening formed by the ring inner wall of the ring body, the ring opening substantially sized and configured to accommodate the liquid container, the ring inner wall disposed at an obtuse angle with respect to the ring bottom and protruding into the ring opening;

a catch channel formed by and between the ring bottom, the ring outer wall and the ring inner wall in the ring body in exterior concentric relationship to the ring opening; and a plurality of wall spacers protruding from at least one of the ring outer wall and the ring inner wall into the catch channel toward an opposite one of the ring outer wall and the ring inner wall, the plurality of wall spacers disengage the opposite one of the ring outer wall and the ring inner wall in an un-deformed state of the ring body and engage the opposite one of the ring outer wall and the ring inner wall in a deformed state of the ring body.

8. The container liquid catch ring of claim 7 wherein the ring body comprises a substantially rigid or semi-rigid material.

9. The container liquid catch ring of claim 7 wherein the ring body comprises a stretchable and elastic material having recoil memory.

10. A liquid container and container liquid catch ring combination, comprising:

a liquid container having a container bottom and a container wall extending from the container bottom; and a container liquid catch ring on the liquid container, the container liquid catch ring including:

a ring body on the liquid container in surrounding and substantially liquid-sealing relationship to the container wall, the ring body positional at a selected height on the liquid container and having a ring bottom, a ring outer wall extending from the ring bottom and a ring inner wall having an inner wall edge extending from the ring bottom in spaced-apart relationship to the ring outer wall, the ring inner wall is disposed at an obtuse angle with respect to the ring bottom and protrudes into the ring opening;

the inner wall edge on the ring inner wall having a diameter less than a diameter of the container wall on the liquid container such that upon deployment of the ring body on the liquid container the liquid container deforms the ring inner wall outwardly toward the ring outer wall and into the catch channel and the inner wall edge of the ring inner wall recoils against and snugly engages an exterior surface of the container wall of the liquid container to form a substantially liquid-tight seal between the ring inner wall and the container wall;

a catch channel in the ring body in exterior concentric relationship to the container wall of the liquid container, the catch channel formed by and between the ring bottom, the ring outer wall and the ring inner wall; and a plurality of wall spacers protruding from at least one of the ring outer wall and the ring inner wall into the catch channel toward an opposite one of the ring outer wall and the ring inner wall, the plurality of wall spacers each having a protrusion cavity at a first surface of the at least one of the ring outer wall and the ring inner wall and each protruding beyond a second surface of the at least one of the ring outer wall and the ring inner wall, the plurality of wall spacers disengage the opposite one of the ring outer wall and the ring inner wall in an un-deformed state of the ring body and engage the opposite one of the ring outer wall and the ring inner wall in a deformed state of the ring body.

11. The liquid container and container liquid catch ring combination of claim 10 wherein the ring body comprises a substantially rigid or semi-rigid material.

12. The liquid container and container liquid catch ring combination of claim 10 wherein the ring body comprises a stretchable and elastic material having recoil memory.

13. The liquid container and container liquid catch ring combination of claim 10 wherein the ring inner wall is recessed with respect to the ring outer wall.

* * * * *